United States Patent [19]

Scheib

[11] 4,038,855

[45] Aug. 2, 1977

[54] STRETCH REDUCING MILL

[75] Inventor: William R. Scheib, Sewickley, Pa.

[73] Assignee: Aetna-Standard Engineering Company, Ellwood City, Pa.

[21] Appl. No.: 677,891

[22] Filed: Apr. 19, 1976

[51] Int. Cl.[2] ..... B21B 31/08; B21B 17/00

[52] U.S. Cl. ..... 72/238; 72/235

[58] Field of Search ..... 72/239, 238, 249, 226, 72/235

[56] References Cited

U.S. PATENT DOCUMENTS

| | | | |
|---|---|---|---|
| 3,221,529 | 12/1965 | Chang | 72/239 X |
| 3,328,973 | 7/1967 | Scheib | 72/239 |
| 3,355,923 | 12/1967 | Gillet | 72/239 |
| 3,748,884 | 7/1973 | Colbath | 72/238 |

*Primary Examiner*—Milton S. Mehr

*Attorney, Agent, or Firm*—Mandeville and Schweitzer

[57] ABSTRACT

The disclosure is directed to improvement in stretch reducing mills utilized in the manufacture of seamless and welded tubing. The stretch reducing mill is well known in its generalities, and the disclosure is directed to improvements in the construction of such mills in the interest of increasing the efficiency of operation and performance of the mill. The disclosure is directed in part to the construction of a multi-stand stretch reducing mill with improved arrangements for removably securing the individual mill stands in position. This includes a heavy, massive structural beam from which all of the individual mill stands are suspended and which additionally serves, when the mill is ready for operation, as a means for holding the mill stands in position. In the latter capacity, the beam contributes both in terms of its great weight and in terms of distributing clamping forces to the individual mill stands from a limited number of clamps. The mill also includes an improved arrangement for longitudinally clamping together a series of consecutive mill stands, using a combination of hydraulic clamping cylinders and a mechanical fail-safe system, enabling the advantages of hydraulic clamping to be enjoyed while avoiding any serious consequences from untimely failure of hydraulic pressure. An additional feature of advantage included in the disclosure is an improved mechanism for effecting simultaneous coupling and decoupling of the individual mill stands to their respective individual drive motors.

15 Claims, 15 Drawing Figures

4
4
10
10
11
19
20
21
42
44
45
46
47
48
60
61
63
64
73
82
93
101
108
109
110
111
112
113
135

7
7
119
120
122
122
132
131
130
133
134
117
118
140
125
141

83
48
44
19
107
92
101
156
84
106
82
97
90
101
154
84
152
82
92
100
21
99

STRETCH REDUCING MILL

BACKGROUND AND SUMMARY OF THE INVENTION

In the manufacture of seamless and welded tubing, it is a conventional practice to initially form the tubing to a larger diameter and with a greater wall thickness than is generally desired. Among the finishing operations to which this tubing is subjected frequently is reduction in size in a stretch reducing mill. The stretch reducing mill typically consists of a series of consecutive mill stands of progressively decreasing diameter, arranged with individual drives, such that each stand is operated at a higher speed than the previous stand. The arrangement is such that, not only is the diameter of the tubing progressively reduced from stand to stand, but the tubing is also placed under controlled tension between stands, resulting in a controlled elongation of the tubing over and above that which would normally result from the fact of the tube being reduced in diameter. By properly relating the reduction in diameter to the elongation, the finished tubing may be controlled both as to its outside diameter and as to its wall thickness.

Since a standard size of incoming tubular stock is customarily processed into finished tubing of various sizes and wall thicknesses, it is generally necessary to set up the stretch reducing mill so as to accommodate relatively frequent reorganization. Typically, this is accomplished by removably mounting the individual mill stands in a base or foundation structure. When it is desired to change over the mill from one size of finished tubing to another, the existing combination of mill stands is removed and replaced by another combination, which is appropriate to the intended new production. Pursuant to the present invention, improvements are provided in the construction of a stretch reducing mill, which greatly facilitate the changeover of the mill from one mill stand combination to another. Thus, providing improved flexibility in production scheduling, while at the same time providing for down time of the mill to be kept at a practical minimum.

According to one of the more specific aspects of the invention, a multi-stand stretch reducing mill is provided in which a series of adjacent mill stands are secured at the top to a massive, retaining beam, which extends the full length of the mill, over the tops of the individual mill stands. The retaining beam is connected or arranged to be connected to each of the mill stands and thus can serve as a means for simultaneously lifting all of the mill stands out of the foundation and conveying them to the preparation floor. This retaining beam, because of its inherent massive weight, serves, when the mills are in working position, to assist in holding the mill stands in place on the mill foundation. In addition, the retaining beam serves as a medium to which vertically downward clamping force may be applied to the individual mill stands, through a relatively limited number of high power clamping devices. By serving in a dual capacity of a hold-down means and also a lifting and carrying means, the massive retaining beam enables the changeover of the mill to be accomplished quickly and with great efficiency.

In accordance with another aspect of the invention, an improved arrangement is provided for longitudinally clamping into the mill foundation a series of individual mill stands. The improved arrangment comprises a series of hydraulic cylinders, arranged in a configuration to correspond to the alignment of spacing bosses provided on each of the mill stands. In conjunction with the several hydraulic cylinders, there is provided a heavy-duty mechanical locking mechanism, which is activated after the mill stands have been hydraulically clamped. In normal operations, the mechanical locking system functions only in a standby capacity. However, should there be a failure or reduction in the hydraulic clamping pressure during operation of the mill, the standby mechanical locking system will prevent any significant displacement of the mill stands, which might otherwise result in serious damage to the mill.

In accordance with a further specific aspect of the invention, an improved and simplified arrangement is provided for effecting the coupling and decoupling of the individual mill stands to their respective drive motors when changing over the mill. The improved arrangement is in the form of a common clutch beam, which extends along the full length of the mill and is carried by a series of crank levers. The series of levers is actuated simultaneously, by actuation of a longitudinally extending tension bar, so that the clutch beam is caused to move transversely with respect to the mill axis to effect declutching. Since a mill of typical construction utilizes alternate high and low drive inputs, the clutch beam assembly of the invention is arranged to extend along the mill between the levels of the upper and lower drives and is provided with alternately upwardly and downwardly extending clutching yokes for engagement with the alternate high and low mill drives.

The prior art considered to be of interest includes the William R. Scheib U.S. Pat. No. 3,328,973, assigned to Aetna-Standard Engineering Co., a subsidiary of White Consolidated Industries, Inc. General features of the mill arrangement are also shown in the Gillet U.S. Pat. No. 3,355,923, the Chang U.S. Pat. No. 3,221,529, and the Kocks U.S. Pat. No. 2,214,279.

For a better understanding of the above and other features and advantages of the invention, reference should be made to the following detailed description of a preferred embodiment, and to the accompanying drawings.

DESCRIPTION OF A PREFERRED EMBODIMENT OF THE INVENTION

Figure 1:
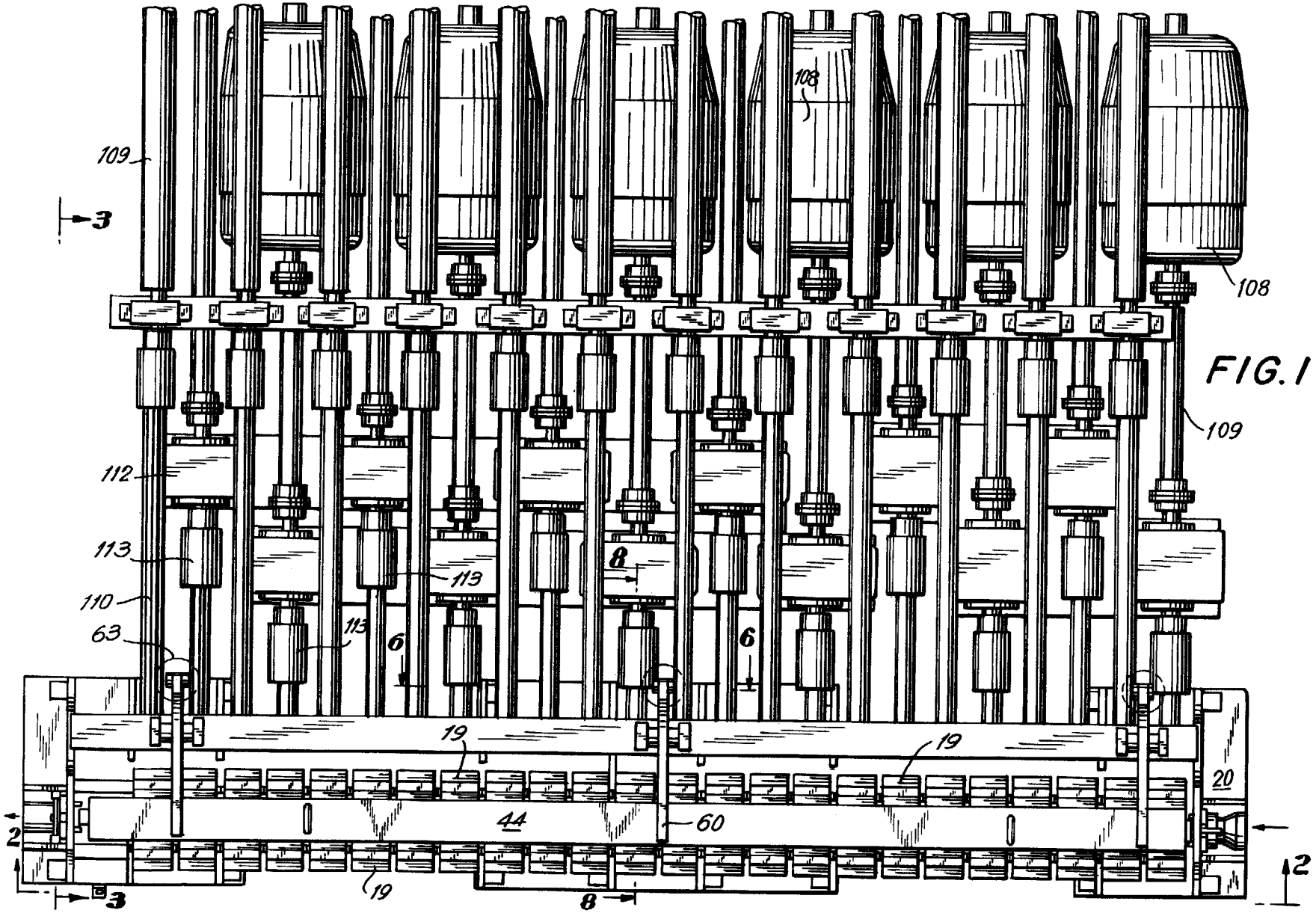
FIG. 1 a top plan view of a stretch reducing mill installation incorporating the improvement features of the invention.
Figures 2, 3:
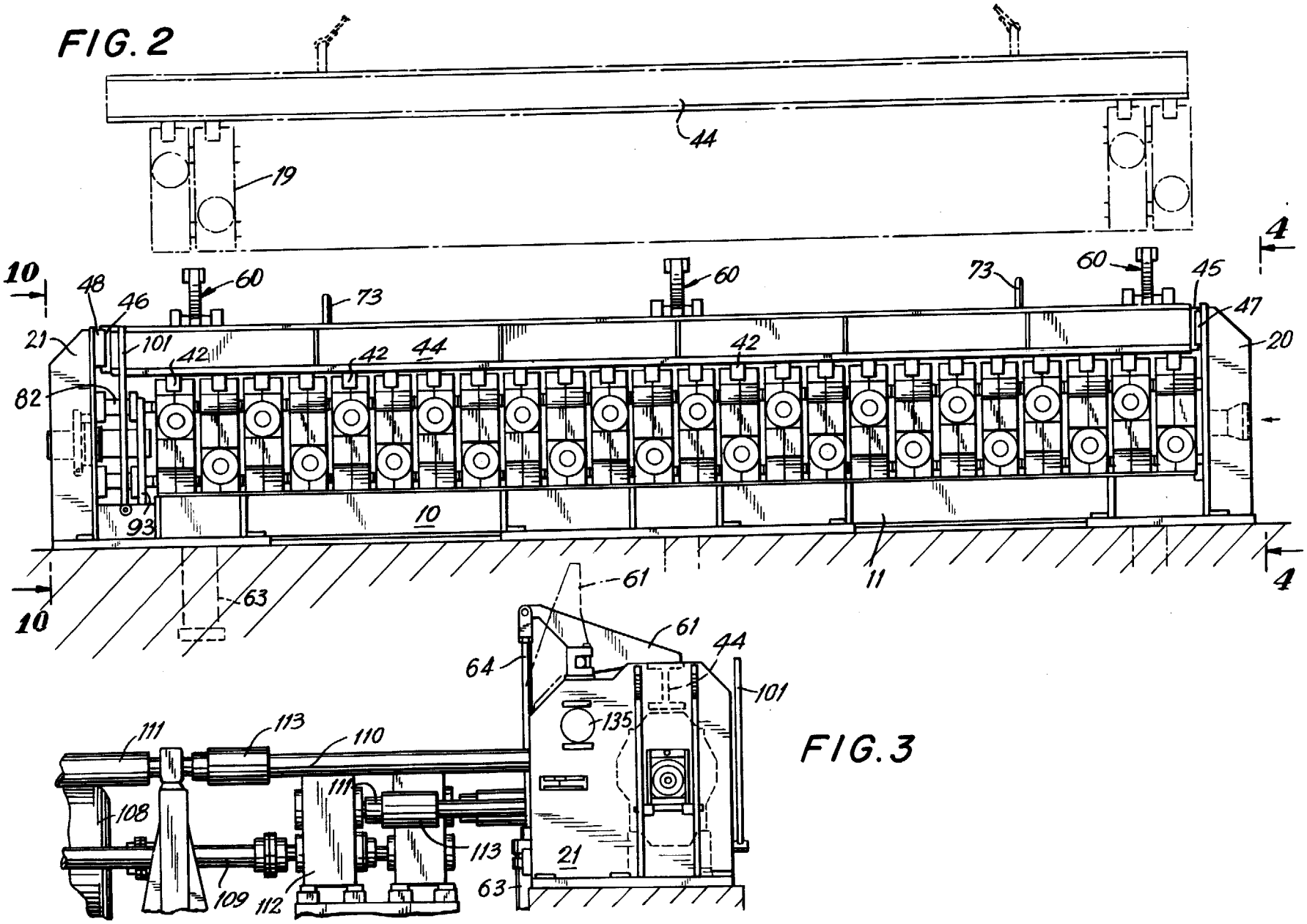
FIGS. 2 and 3 are front elevational and end elevational views respectively of the mill installation, as generally viewed on lines 2—2 and 3—3 of FIG. 1, with FIG. 3 showing the exit or discharge end of the mill.
Figure 4:
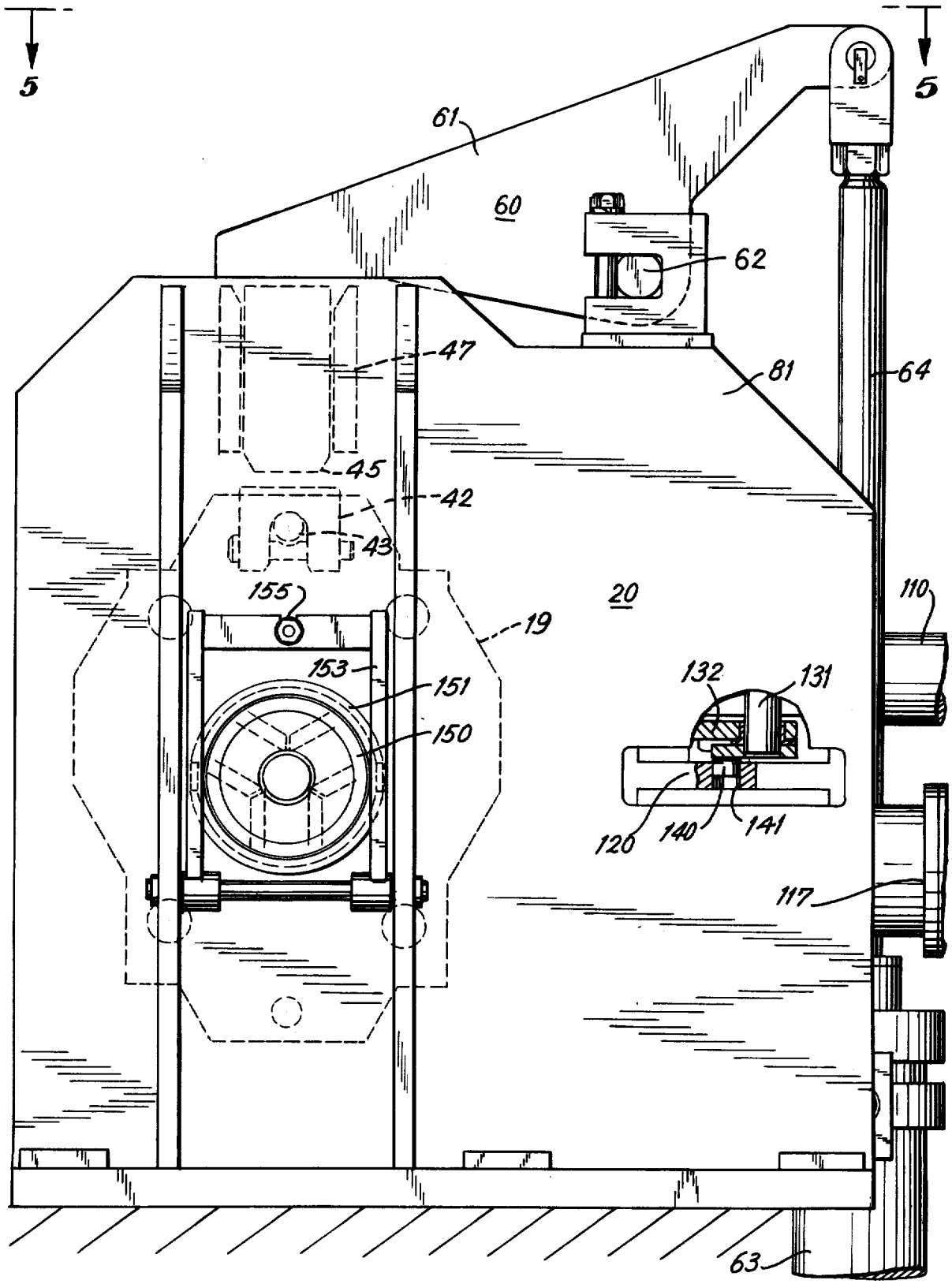
FIG. 4 is an end elevational view of the entry end of the mill, with parts broken away to illustrate certain details.
Figure 8:
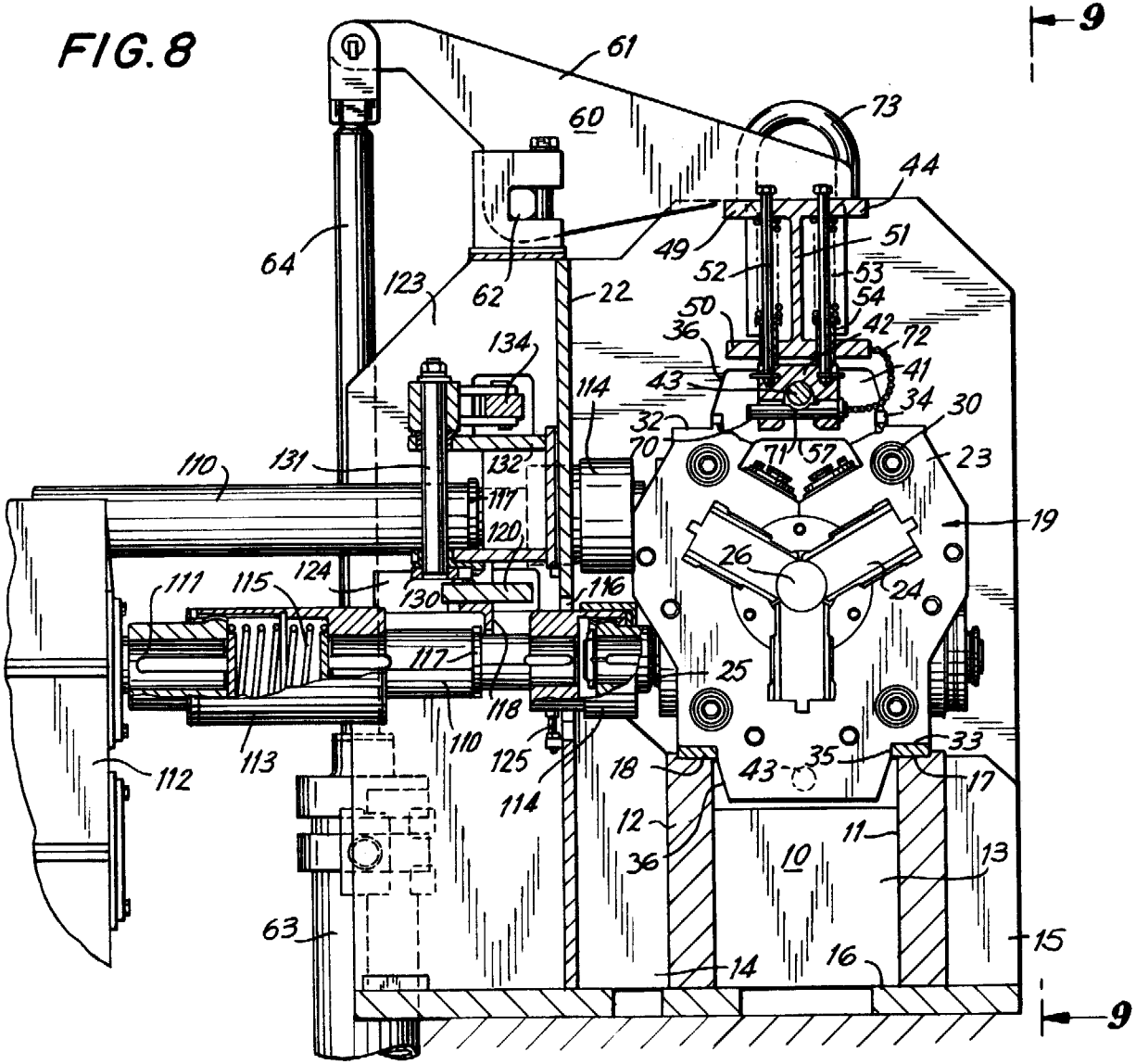
FIG. 8 is a cross sectional view as taken generally along line 8—8 of FIG. 1.
Figure 10:
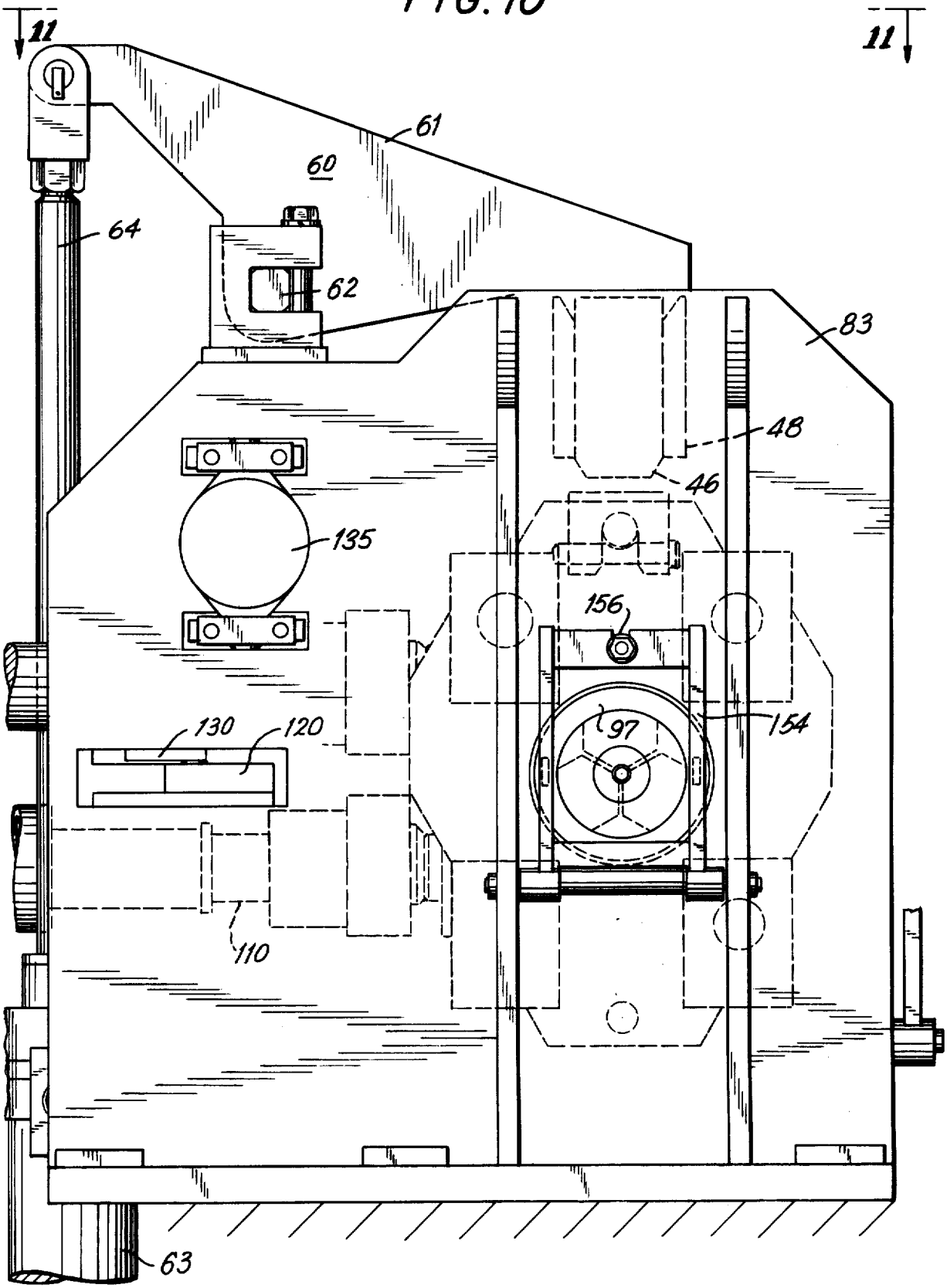
FIG. 10 is an enlarged, end elevational view of the exit end of the mill, as viewed generally on line 10—10 of FIG. 2.

Referring now to the drawings, and initially to FIGS. 1 and 2 and 8 thereof, the stretch reducing mill of the invention includes a foundation structure 10, which includes a pair of elongated, longitudinally extending foundation beams 11, 12 connected together and supported at appropriate places by plates 13–16, forming a rigid weldment structure. Along the tops of the foundation beams 11, 12 extend foundation rails 17, 18, on which are received and supported a plurality of mill stands 19. In the representative mill disclosed herein, provision is made for up to twenty-four active mill stands, although in many cases less than twenty-four active stands are required, in which case some of the stands at the exit end of the series may be dummies.

At each end of the foundation 10 there is provided an end frame structure 20, 21 (at the entry and exit ends respectively). The end frames are secured to the foundation beams 11, 12, and also are connected longitudinally by a plate structure 22 (FIG. 8) which extends the full length of the foundation along the back or drive side. Thus, the end frames 20, 21 form part of a rigid foundation and frame structure for the several mill stands 19.

The individual mill stands 19, one of which is evident in FIG. 8, include mill housings 23, which may either be roll housings, or dummies. In the illustration of FIG. 8, the housing 23 supports three working rolls 24 arranged in a Y configuration. These rolls are geared together and are arranged to be driven through an input shaft 25 connected to a drive system in a manner to be described. Typically, the next successive mill housing will be inverted, so that the next set of working rolls has a configuration of an inverted Y. To this end, in accordance with known general principles, the mill housings 23 are designed to be generally symmetrical about the central axis 26, so that any mill housing may be installed right side up or upside down. The drive shaft 25 for each mill housing is offset somewhat from the central axis 26 of the mill pass such that, with the housing in one orientation, the drive shaft is below the pass line and, with the housing in the reverse orientation, the drive is above the pass line. By this means, alternate housings may be arranged with high and low drive inputs.

Figure 9:
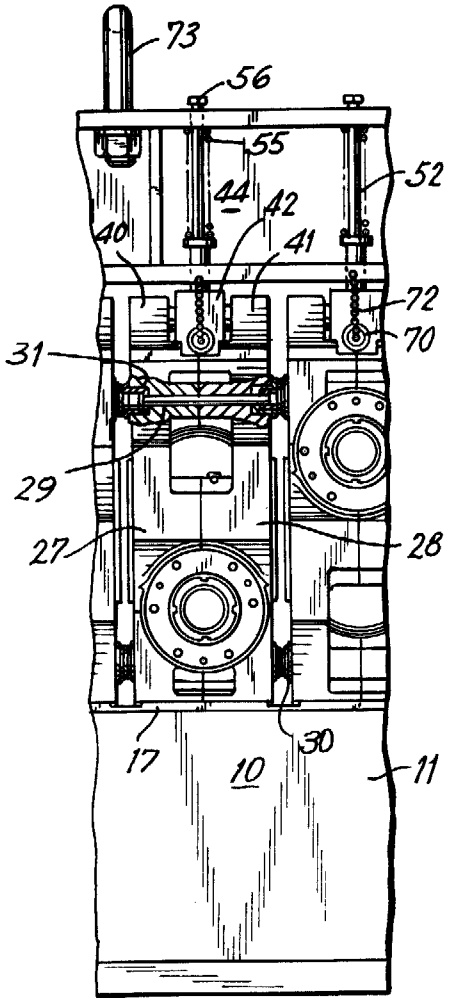
FIG. 9 is a fragmentary, front elevational view as if viewed on line 9—9 of FIG. 8, with parts broken away to illustrate certain details.

As is shown best in FIGS. 8 and 9, the mill housings 23 advantageously consist of two symmetrical housing halves 27, 28 which, together, contain the various support bearings and drive gears for the mill rolls 24. The housing halves 27, 28 are connected together by a plurality of through bolts 29. On the front and back faces of the assembled housing, there are provided four bosses 30. These are machined to considerable accuracy to define the front and back planes of the housing 23 and to establish the overall thickness of the housing to very close tolerances. In some cases, it may be desired to utilize special machined inserts 31 (FIG. 9) to form the bosses 30. In other cases, the bosses may be an integral part of the housing halves 27, 28. In either case, it may be desirable to recess the center area of the bosses to receive the heads and nuts of the clamping bolts 29.

Each of the mill housings 23 is precision machined to form upper and lower support surfaces 32, 33 and adjacent lateral guide surfaces 34, 35. These support and guide surfaces are accurately located with respect to the pass line 26 of the mill such that, when the mill housing is supported on the foundation rails 17, 18, in either orientation of the housing, the axis of the housing is precisely located on the mill pass line, both vertically and transversely. Desirably, the upper and lower extremities of the mill housings are tapered at 36, to assist in guiding of the housing into position of the foundation rails 17, 18 during the make-up of a mill assembly.

In accordance with one aspect of the invention, each of the mill housings 23 is provided on its upper and lower ends with spaced front and back flanges 40, 41 defining a space for the reception of a U-shaped hold-down block 42, to be further described. A combined lifting and hold-down pin 43 extends between each of the flanges 40, 41, the pin being aligned with the central vertical axis through the mill housing.

Figure 5:
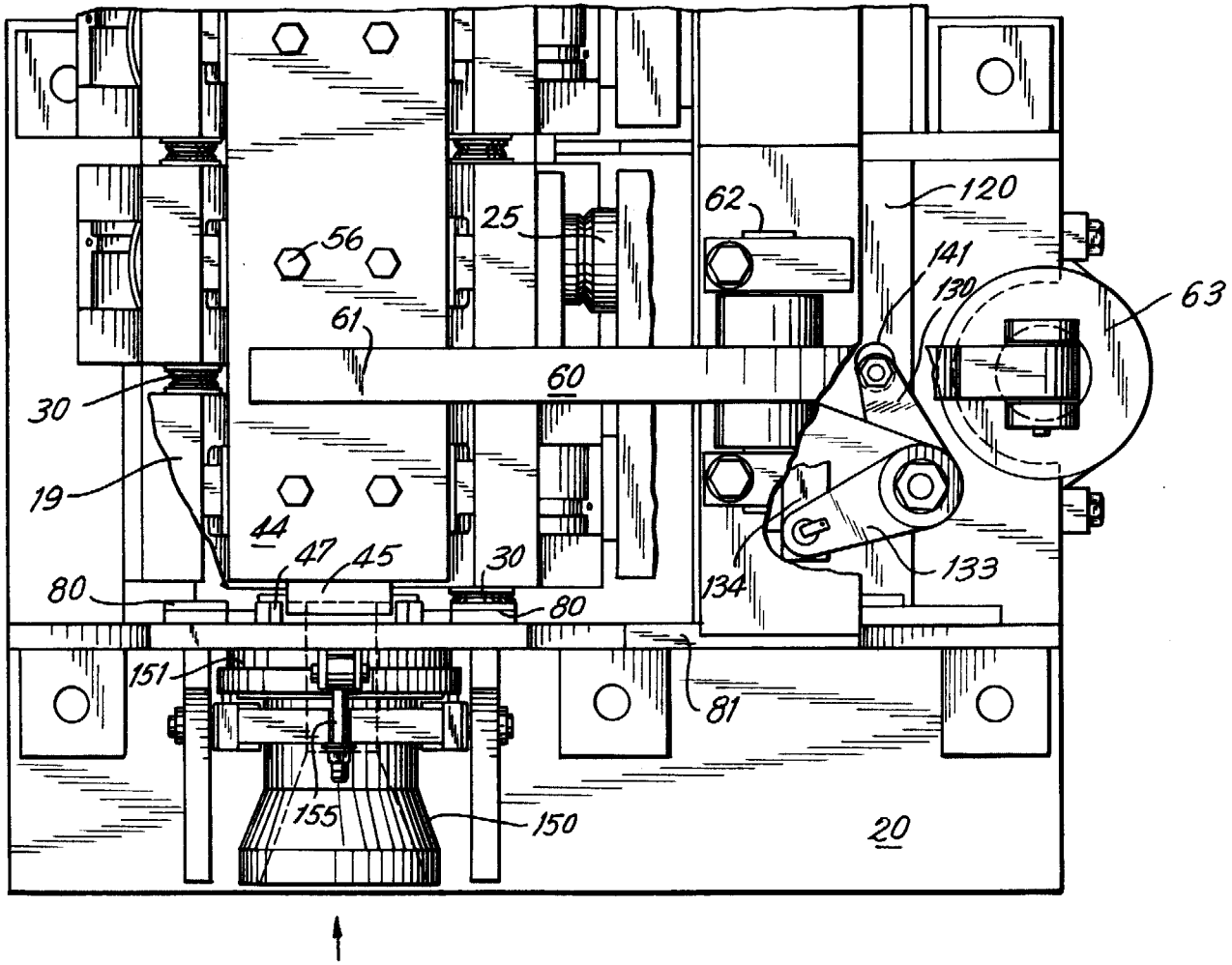
FIG. 5 is a fragmentary top plan view of the entry end section of the mill.

Engaging each of the several mill housings 24, by means of their respective lifting and hold-down pins 43, is an elongated retaining beam 44. The beam extends the full length of the foundation frame and has keys 45, 46 at each end (see FIGS. 5, 11) slideably engagable with vertical guides 47, 48 in the respective entry and exit end frames 20, 21. As reflected in FIGS. 8 and 9, the retaining beam 44 is provided with a hold-down block 42 for each location of mill stand, properly aligned to be received between the spaced housing flanges 40, 41.

In the illustrated arrangement, the retaining beam 44 advantageously is in a form of a rather massive H-beam having heavy upper and lower flanges 49, 50 and a central vertical web 51. At each mill housing location, a pair of elongated bolts 52, 53 extend slidingly through the flanges 49, 50, on opposite sides of the central web 51, each pair of bolts engaging a hold-down block 42 at their lower ends. Flanged bushings 54 surround the lower portions of the bolts 52, 53 and engage the upper surface of the hold-down block. Heavy compression springs 55 are provided about the upper portions of the bolts 52, 53, maintained in compression between the upper beam flange 49 and the flanged bushings 54. The springs 55 serve normally to urge the bushings 54, bolts 52, 53 and hold-down blocks 42 downwardly, to positions limited by the bolt heads 56. However, when the retaining beam 44 is lowered down onto a series of assembled mill housings, the lifting and hold-down pins 43 are received in the downwardly opening bight areas 57 of the hold-down blocks 42, eventually becoming seated in the closed ends of the bight areas, and displacing the hold-down blocks relative to the retaining beam 44, against the compression springs as the latter continues to be lowered. Accordingly, when the retaining beam 44 is in position, the series of mill housings is pressed downward by the massive weight of the beam acting through the several pins 43.

Although the retaining beam 44 in the illustrated mill structure contributes significantly to the necessary hold-down force for the mill housings, the structure of the invention further includes a limited number of hold-down clamps, which are arranged to engage and forceably press downward on the upper flange 49 of the retaining beam to augment the downward acting weight of the beam. Because of the inherent strength and relative rigidity of the massive retaining beam 44, a limited number of hold-down clamps may be utilized, with the clamping force being distributed effectively through the heavy beam. In a representative mill, the springs 55 may be pre-loaded to an initial compression force of about, say, 750 pounds each. When clamping force is applied, this may be increased to, say, 1,250 pounds per spring.

With reference to FIGS. 2, 3 and 8, for example, the clamping means of the representative mill includes three sets of clamps 60, each consisting of a heavy clamping lever 61 pivoted at 62 on the structural weldment which forms the mill foundation and pivotable between clamping and release positions by means of heavy fluid cylinders 63 connected to the clamping levers by elongated operating rods 64. As shown in FIG. 3, for example, the clamping levers 61 are generally horizontal, when pressing downward on the retaining beam 44, and are pivoted to a generally vertical position, as shown in phantom lines, in order to release the retaining beam for removal of the mill housings. As reflected particularly in FIG. 2, a representative mill is provided with clamping assemblies adjacent each end and in the center of the mill. This, in conjunction with the relatively massive weight of the beam, serves to provide highly reliable and effective vertical clamping of the several mill housings.

In accordance with a significant aspect of the invention, the several mill housings are arranged to be both lifted and held down, as desired, by means of the retaining beam 44. To enable the mill housings to be lifted, each of the hold-down blocks 42 is provided with a lifting pin 70, arranged to be received transversely in the downwardly projecting legs of the holding block 42. The lifting pins 70, which are advantageously provided with curved recesses to receive the housing pins 43, are slidingly received in the hold-down blocks 42, and are advantageously permanently connected to the retaining beam 44 by a chain 72. When the beam 44 is lowered into position on a preassembled group of mill housings 23, the respective lifting pins 70 are inserted in place such that, when the beam is thereafter lifted, the entire group of mill housings is lifted by engagement of the pins 70 and 43. The arcuate recesses 71 in the lifting pins become engaged with the housing pins 43 during lifting, to effectively lock the lifting pins in position. In order to release a housing from the retaining beam 44, it is merely necessary to withdraw the appropriate lifting pin or pins and lift the beam. To facilitate lifting of the beam, it may be provided with appropriately located U-shaped bolts 73 (FIG. 2) engagable by suitable crane and sling.

As will be readily appreciated, while a given mill setup is in operation on the production line, an appropriate mill combination for the next production sequence may be preassembled on the preparation floor and, if two or more retention beams 44 are provided, the new mill combination may be set up, with its retaining beam in position and all of its lifting pins 70 secured. To change over the mill to a new production requirement, all that is required is to unclamp and uncouple (by means still to be described) the mill stands from the foundation structure, release the vertical hold-down clamp 60 and lift off the retaining beam 44 with a suitable crane and sling, as reflected in phantom lines in FIG. 2. This assembly may be carried over to and deposited on the preparation floor, where the crane can be connected to the pre-prepared new mill combination, which is quickly carried over into position and lowered into the foundation structure, clamped and coupled. The entire sequence can be accomplished in a practical minimum of time.

In some cases, it may not be necessary to remove all of the mill stands 19 during a mill changeover. In such cases, selected ones of the lifting pins 70 are simply pulled out of the hold-down blocks 42 before the retaining beam 44 is lifted. The disconnected mill stands simply remain in position, while those whose lifting pins 70 are connected are lifted away.

Figure 11:
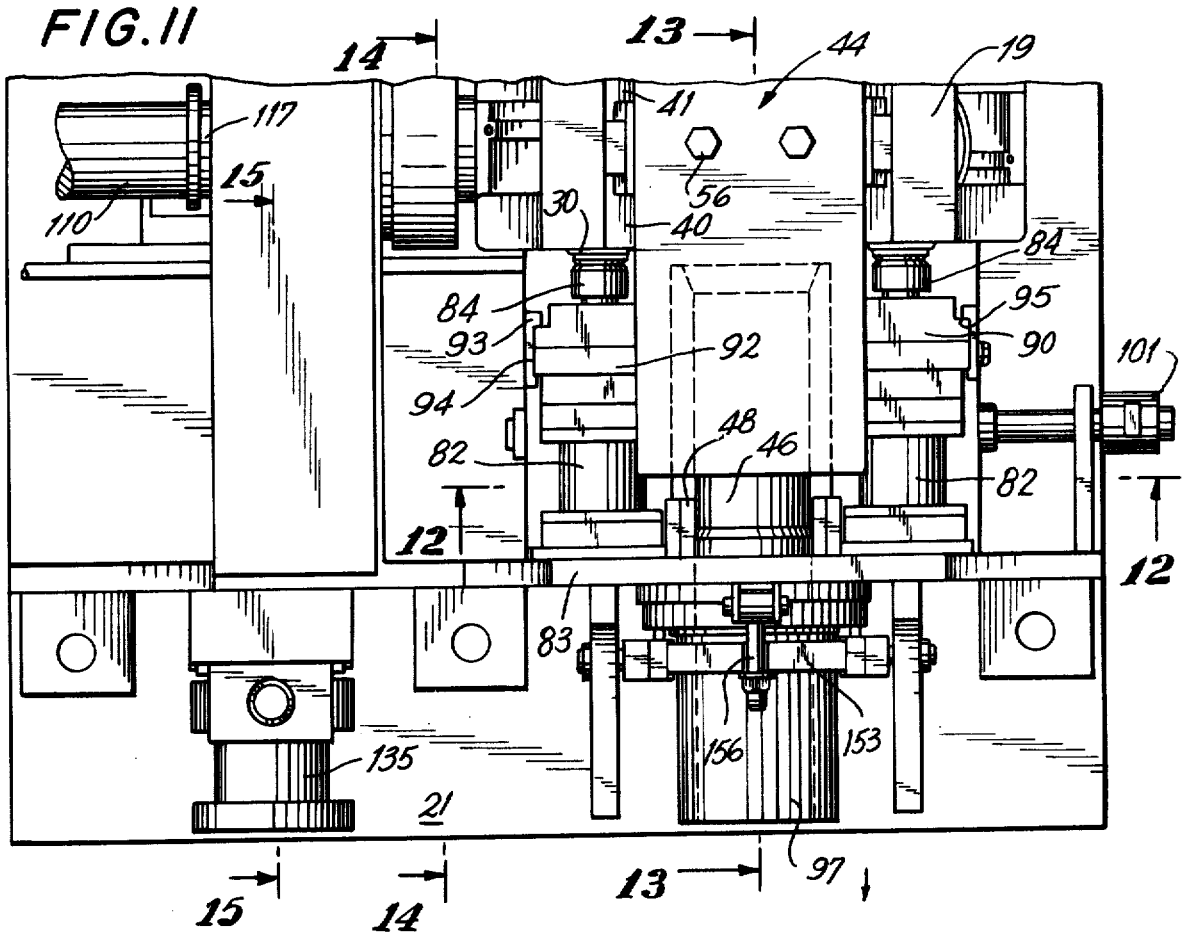
FIG. 11 is a fragmentary top plan view of the exit end of the mill.

In accordance with known principles, it is desired to longitudinally clamp the entire series of mill stands, so that they are packed tightly and solidly from one end to the other of the mill. To this end, the upstream or entry end of the mill (see FIG. 5) is provided with a plurality of compression pads 80, which are mounted on the end frame plate 81 and are accurately aligned with the machined bosses 30 of the mill stands 19. The entire stack of twenty-four mill housings is placed in compression by means of four hydraulic cylinders 82 mounted on the end frame plate 83 at the exit end (FIG. 11). The base ends of the cylinders 82 are mounted on the inside face of the plate 83, and the rod ends of the cylinders extend upstream and are provided with pads 84 arranged to engage the bosses 30 of the mill housing 19 at the exit end. After all of the mill housings have been lowered to place by the retaining beam 44, the four hydraulic cylinders 82 are actuated to extend, pressing on the four bosses 30 of the last mill stand and thereby placing all of the mill stands under compression through the aligned series of bosses 30. Desirably, the bosses are machined to predetermined narrow mill housing thickness tolerances (e.g., plus zero to minus six mils), so that the maximum tolerance range for the entire series of twenty-four mill stands is very small (e.g., around an eighth of an inch). The longitudinal compression of the cylinders 82, in conjunction with the vertical clamping afforded by the beam 44 and clamping assemblies 60 serves to solidly hold the several mill stands in position in the foundation structure 10.

Pursuant to one of the more specific aspects of the invention, a simplified yet reliable arrangement is provided for mechanically locking the several hydraulic cylinders 82 against the eventuality of a loss of substantial reduction or hydraulic pressure. To this end, a heavy locking plate 90 (FIGS. 11–14) is mounted for vertically guided sliding movement in the frame structure. To advantage, the front or downstream face 91 of the locking plate 90 may be slideably supported against bearing plates 92 mounted on the front faces of the several longitudinal clamping cylinders 82. The bearing plates 92, being solid with the cylinders, are in turn solid with the exit end frame structure 21, to which the hydraulic actuators 92 are directly mounted. Along the outside faces of the bearing blocks 82 are secured side bearings 93, which slideably engage the side and front edges 94, 95 of the locking plate 90, limiting the plate to vertical movement.

Figure 12:
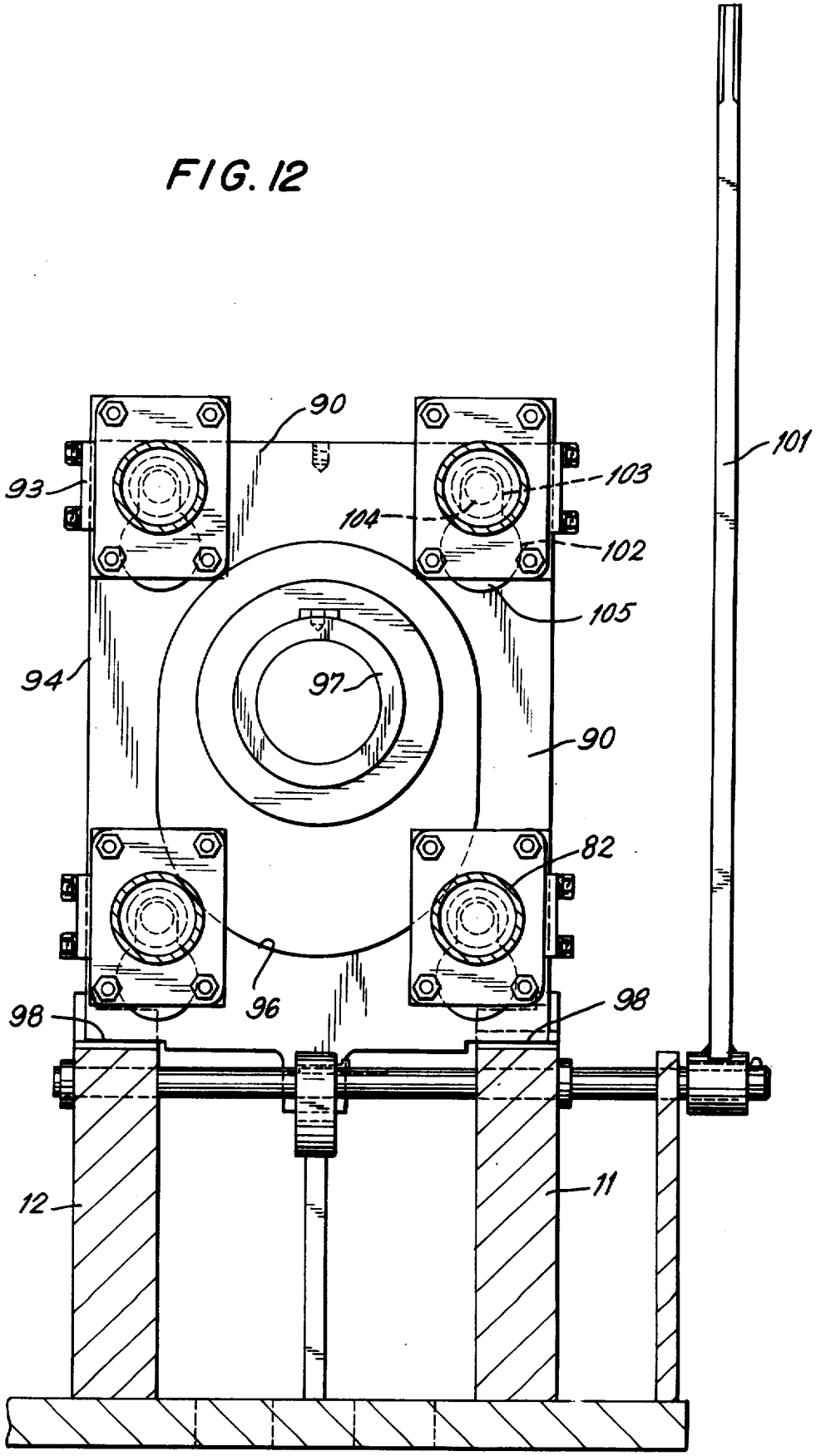
Figure 13:
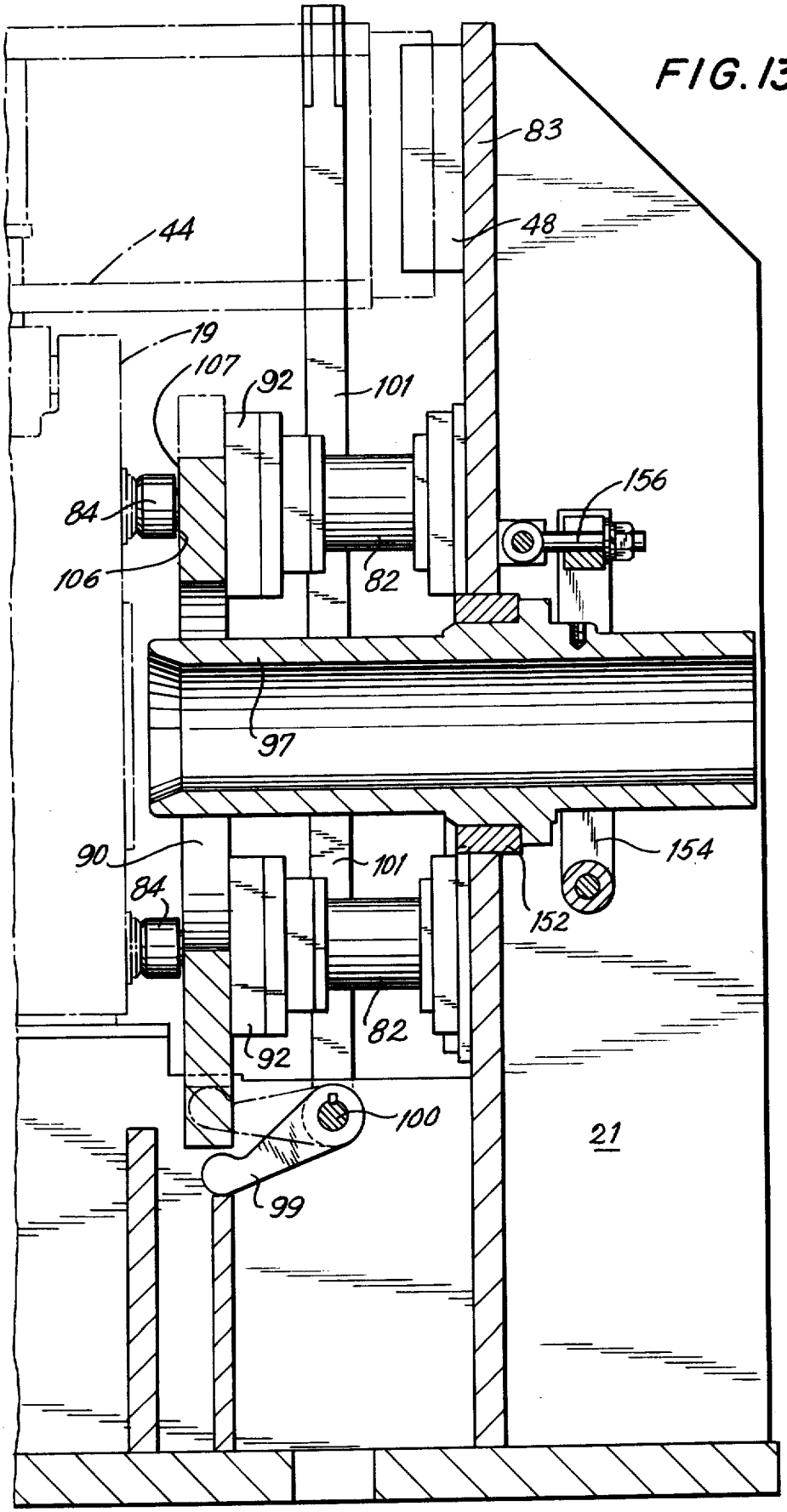
Figure 14:
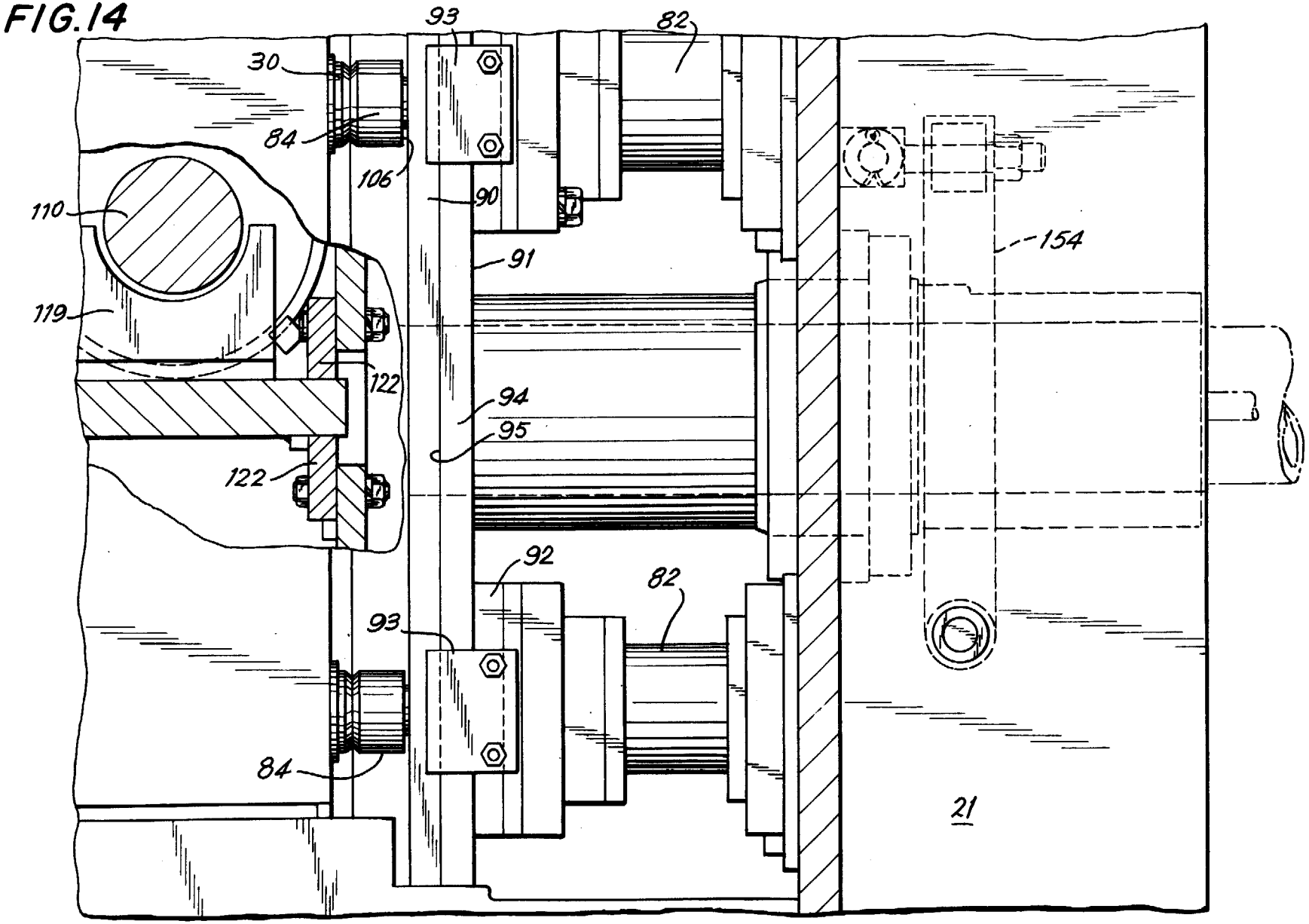

As shown best in FIG. 12, the locking plate 90 is provided with a large central opening 96 arranged to receive an exit guide sleeve 97. The plate 90 normally rests upon supporting surfaces 98 of the foundation beams 11, 12, but it is capable of being raised by a lever 99 (FIG. 13) keyed to a shaft 100 and operated by a manual lever 101. The locking plate 90 is provided with four keyhole-shaped openings 102, the upper or narrow portions 103 of which are large enough to receive the rod portions 104 of the hydraulic actuators 82, while being substantially smaller than the enlarged compression pads 84 provided at the end extremities of the actuator rods. The lower portions 105 of the keyhole openings are large enough to accommodate the compression pads 84. When the locking plate 90 is raised, by drawing back of the manual lever 101, the enlarged portions of the keyhole-shaped openings are aligned with the compression pads 84, and the actuating cylinders 82 may be retracted to unclamp the stack of mill stands. Thereafter, when a new stack of stands is in place, and the actuators 82 are energized to extend and apply clamping force, the compression pads 84 will be extended beyond the upstream face of the locking plate 90 (see FIG. 13). Desirably, the clearance between the back face 106 of the compression pads and the front face 107 of the locking plate will be very small, sufficient only to accommodate manufacturing tolerances in the thickness of the mill stands. After the mill stands are clamped, the manual lever 101 may be returned to an upright position, lowering the locking plate, until the narrow portion of the keyhole openings lie behind the compression pads. Thereafter, if there is any loss of fluid pressure in the actuators 82, the clamped mill stands will not be completely released, but will be released only to the extent of the slight clearance between the compression pads and the upstream face of the locking plate. This enables the mill to be brought to a stop without serious damage to its components.

In the mill structure of the invention, a somewhat simplified and improved arrangement is provided for effecting simultaneous coupling and decoupling of the plurality of mill stands, to permit removal and replacement thereof. In this respect, the coupling and decoupling mechanism of the invention is intended to be a specific improvement upon the type of arrangement shown in, for example, the Gillet U.S. Pat. No. 3,355,923. Each of the mill stands, of course, has its own motor 108 and motor drive shaft 109. The drive shaft 25 of the mill is coupled with a retractable drive shaft 110 connected to a gear reducer 112 by means of a sliding, splined coupling 113 and shaft 111. At the forward end of each of the drive shafts 110 is a splined clutch coupling 114 which engages with the splined end of the housing drive shaft 25. Springs 115, within the splined drive coupling 113 serve to urge the clutch couplings 114 into driving engagement with the housing shafts 25, in a known manner.

In order to decouple the drive shafts 110 from the mill stands 19, the drive shafts 110 are retracted away from the mill stands, against the action of the springs 115, until the coupling sleeve 114 is completely separated from the splined end of the mill drive shaft 25. Suitable openings 116 are provided in the foundation back wall 22 to receive the coupling sleeve 114 and permit full retraction thereof to disengage the mill stands.

To effect the desired retracting movement of the shafts 110, each is provided with a collar or shoulder 117 engagable by yokes 118, 119 which extend respectively downward and upward from a clutch bar 120. According to one aspect of the invention, the clutch bar arrangment, although effectively extending the full length of the mill, need not and advantageously does not constitute a single uninterrupted bar. Rather, the bar is advantageously divided into a plurality of segments (typically three) with each segment being supported at its ends by suitable bearings 122 (see FIGS. 6, 14) for transverse sliding movement relative to the foundation structure. To this end, each of a plurality of transversely disposed structural plates 123, forming part of the foundation weldment structure, is provided with a suitable opening 124 for the reception and horizontal transverse movement of the clutch bar 120. Some, but typically less than all of these plate openings will be provided with slide support bearings 122.

The yoke members 118, 119 conveniently may be short sections of angle, one flange of which is bolted to the clutch bar 120 and the other flange of which is appropriately recessed to embrace the forward portions of the drive shafts 110, in front of the collars 117. Accordingly, when the clutch bar segments 120 are moved transversely, in a direction away from the mill stands 19, the collars 117 will be engaged by the respective clutch yokes 118, 119. This will effect the desired retraction of the drive shafts and disengagement of the mill stand drive shaft 25. For temporary support of the disengaged drive shaft, a pair of adjustable bolts 125 is positioned underneath each drive shaft. As the drive shafts are retracted, the clutch sleeves 114 are brought into a position above the supporting bolts 125. When the sleeves 114 are fully disengaged, they will drop down slightly on to the heads of the bolts 125, in an appropriate position to be reengaged with the next batch of mill stands. It will be understood, of course, that the mill drives are stationary at this time.

In order to effect actuation of the clutch bar sections 120, each is engaged near each end by a crank lever arm 130 secured to a vertical shaft 131 mounted by a bracket 132 on the foundation structure. At the opposite end of the shaft 131, is a second crank lever 133 pivotally connected to a pull rod 134. The pull rod, which may consist of a plurality of connected-together segments, is connected at the exit end of the foundation with an actuating cylinder 135.

Figures 6, 7:
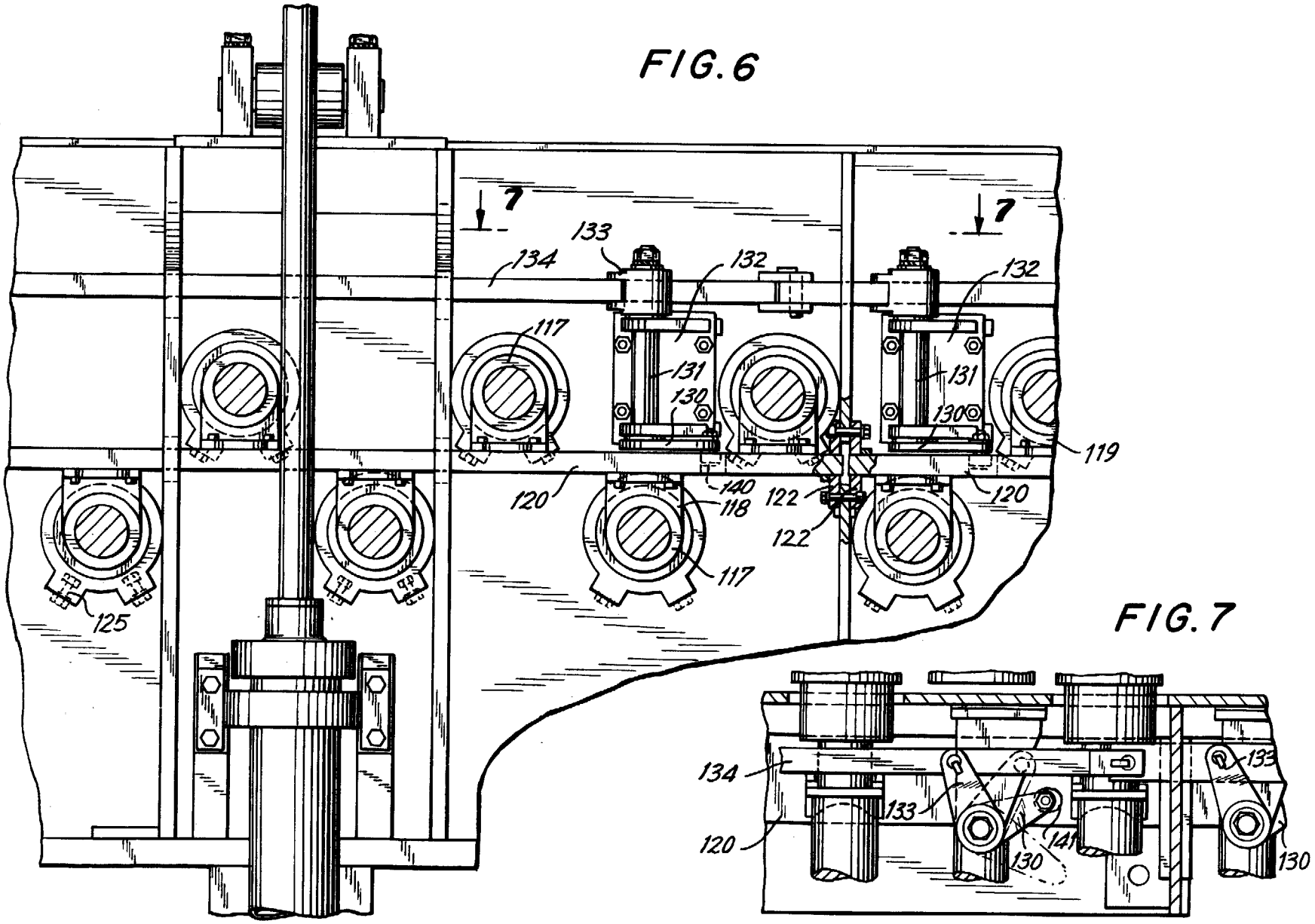
FIG. 6 is an enlarged, fragmentary cross sectional view as taken generally on line 6—6 of FIG. 1.
FIG. 7 is an enlarged, fragmentary cross sectional view as taken generally on line 7—7 of FIG. 6.
Figure 15:
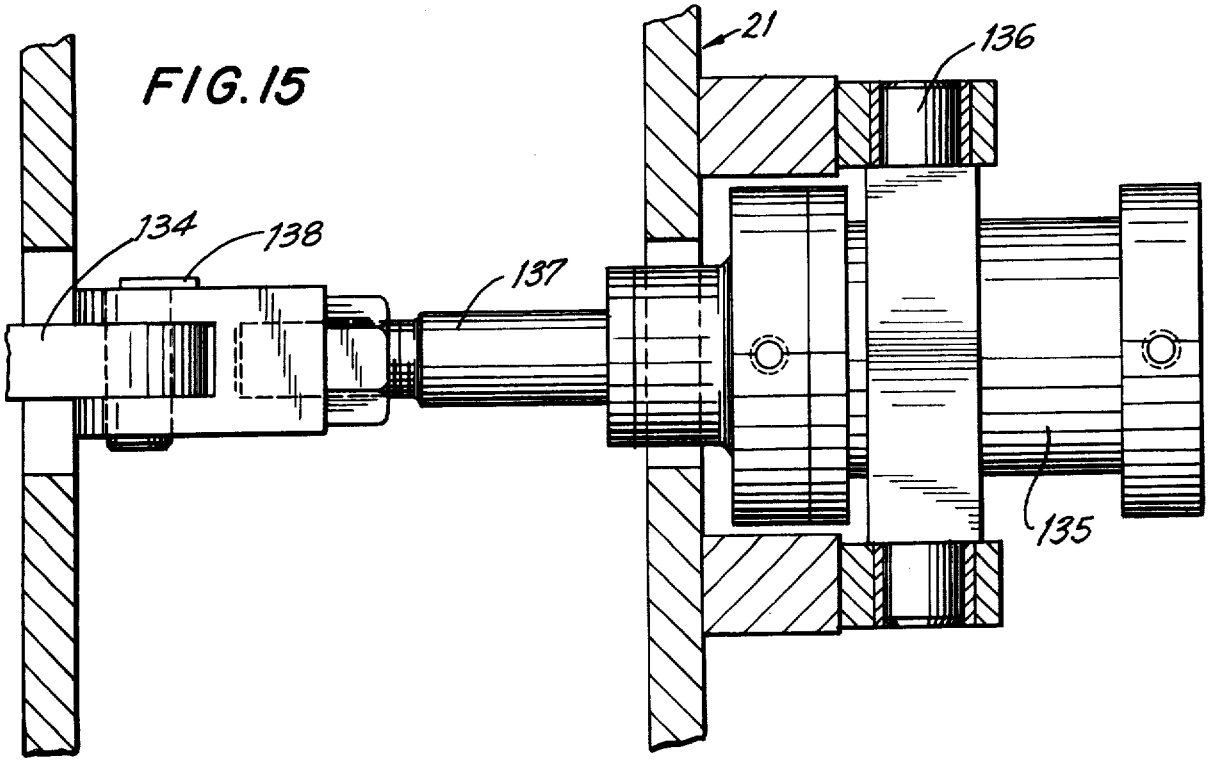
FIGS. 12–15 are fragmentary cross sectional views as taken generally along lines 12—12 to 15—15 respectively of FIG. 11.

As is reflected in FIG. 7, the upper crank levers 133 are arranged substantially at right angles to the lower crank levers 130. The arrangement of these levers and of the pull rod 134 and actuator 135 is such that, when the actuator 135 is energized to retract, the pull rod 134 is drawn to the left in FIG. 7 a distance sufficient to pivot the upper crank lever 133 through about 30° of arc, passing through a position at right angles to the pull rod to a position as shown in phantom lines in FIG. 7. During this movement, the pull rod 134 is displaced slightly in a transverse direction. However, the limited transverse movement is accommodated easily by pivotable mounting of the actuator 135, at 136, and pivotable connection of the cylinder rod 137 to the pull rod at 138 (see FIG. 15).

Movement of the clutch bar segments 120 is substantially confined to movement parallel to the axes of the drive shafts 110. Accordingly, the crank levers 130 are connected to the clutch bars 120 by means of rollers 140, which are received in longitudinally elongated slots 141. The elongation of the slots 141 accommodates the slight longitudinal component of motion of the rollers 140, as the levers 130 are pivoted through their normal working arcs.

When the clutch actuator 135 is energized to extend, and permit return of the clutch bar 120 to its forward position, all of the drive shafts 110 are urged to extend by means of the spring urged couplings 113. This permits the splined coupling 114 to become engaged with the drive shafts 25, as soon as the splines are properly aligned.

When changing a mill stand combination, it may also be appropriate to change the entrance and exit guide bushings. To this end, entrance and exit guide bushings 150, 97 respectively are removably received in collars 151, 152 mounted on the end frame structures 20, 21. These bushings are held in place by gates 153, 154, which are pivoted in the end frames and are removably locked in operating position by swing bolts 155, 156. To change the guide bushings, the swing bolts are released and swung out of the way, permitting the gates 153, 154 to be pivoted downward out of the way and enabling the guide bushings to be withdrawn axially from the end frame.

SUMMARY OF OPERATION

In order to set up the stretch reduction mill for a given production run, a series of mill stands 19 is assembled on the preparation floor in the proper sequence. In general, an entire mill sequence is set up, including dummy stands at the downstream end, in cases where the full compliment of working mill stands is not required for the particular production scheduling. The preassembled mill stands are then individually engaged by the lifting pins 70 and U-shaped hold-down brackets 42 of a retaining beam 44, which extends over the full length of the mill stand assembly.

At the appropriate time, the retaining beam 44 is simply lifted bodily, along with all of the attached mill stands, and carried over to the foundation structure of the mill, where it is lowered carefully into place. In this connection, the slightly tapered end extremities of the mill stands will assist in guiding the individual stands into position on the foundation rails 17, 18. When the mill stands are finally at rest on the rails, they are accurately located vertically and transversely by reason of the precision machining of the surfaces 33, 35 in relation to the rails 17, 18.

As the beam is lowered, its end extremities are guided into slots in the end frame structures 20, 21, which confine but do not support the ends of the beam.

With the assembly of mill stands now loosely positioned on the foundation rails 17, 18, the entire stack of mill stands is locked together as a solid structure, and placed under compression, by energizing the four actuators 82, carried by the exit end frame 21. As these actuators are extended, the locking plate 90 is lowered into locking position, behind the compression pads 84, to prevent unintentional release of the several mill stands.

After the mill stands have been longitudinally compressed, the vertical clamping actuators 63 are energized, displacing the retaining beam 44 downward against the compressed springs 55. With the clamping levers 61 in their downward limit positions, the retaining beam 44 is held in a position spaced slightly above the tops of the hold-down blocks 42. Accordingly, all of the mill stands are urged downwardly under substantially equal forces determined by the compression of the heavy springs 55.

With the mill stands now clamped in place, the clutch bar 120 can be released, permitting the splined couplings 114 to move forwardly, engaging the various drive shafts 25. The mill is then ready for normal operations.

Since the retaining beam 44 remains in position above the mill stands, and indeed serves as the means for holding them in place, subsequent removal of an entire mill stand assembly is effected quickly and efficiently by simply releasing the vertical and longitudinal clamping forces on the mill stands, uncoupling the drives and lifting the retaining beam 44 bodily from the mill foundation, by means of a crane. The just removed assembly is carried by the crane to the preparation floor, where a new prepared assembly is picked up and carried back to the mill. The entire changeover sequence can be carried out with a minimum of interruption of the production of the tube mill, as will be appreciated. This is of particular importance, of course, where the tube is formed on a continuous basis, as in a continuous buttweld or continuous electric weld mill.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a rolling mill of the type comprising a foundation, a plurality of individual mill stands adapted for removable reception in said foundation, mill drive means, means for clamping the mill stands in said foundation, and means for coupling the mill stands to said drive means, the improvement in said clamping which comprises, a. a heavy, relatively rigid retaining beam extending over the tops of each of the mill stands and urging said stands forcibly downward into seated positions on said foundation, b. said foundation forming a rigid support upon which said mill stands are seated, c. means connecting said mill stands individually to said retaining beam, and d. means for bodily lifting said retaining beam from said foundation together with said individually connected mill stands for effecting a mill change-over.

2. In a rolling mill of the type comprising a foundation, a plurality of individual mill stands adapted for removable reception in said foundation, mill drive means, means for clamping the mill stands in said foundation, and means for coupling the mill stands to said drive means, the improvement in said clamping which comprises, a. a heavy, relatively rigid retaining beam extending over the tops of each of the mill stands and urging said stands downward against said foundation, b. means connecting said mill stands individually to said retaining beam, and c. means for bodily lifting said retaining beam from said foundation together with said individually connected mill stands for effecting a mill change-over, d. said connecting means comprising individual hold-down blocks carried by said retaining beam and adapted to bear individually on said mill stands, e. individual spring means connecting said individual hold-down blocks to said retaining beam and arranged to maintain downward force on said blocks when said retaining beam is in working position in said foundation.

3. The improvement of claim 2, further characterized by a. said hold-down blocks being of generally inverted U-shaped configuration engageable in their downwardly opening bight portions with respective ones of said mill stands, b. mill stand pick up elements carried by lower end portions of said hold-down blocks and engageable with said mill stands for lifting said stands along with said retaining beam.

4. The improvement of claim 3, further characterized by a. said mill stand pick up elements comprise removable pins slideably received in downwardly extending leg portions of said hold-down blocks.

5. The improvement of claim 1, further characterized by a. a limited plurality of clamping members operable to act downward on said retaining beam in limited, widely spaced areas.

6. The improvement of claim 1, further characterized by a. a limited plurality of clamping members operable to act downward on said retaining beam in limited, widely spaced areas, b. said clamping members comprising levers pivoted on said foundation and movable between clamping positions, engaging said retaining beam, and release positions accommodating removal, by lifting, of said retaining beam and mill stands.

7. In a rolling mill of the type comprising a foundation, a plurality of individual mill stands adapted for removable reception in said foundation, mill drive means, means for clamping the mill stands in said foundation, and means for coupling the mill stands to said drive means, the improvement in said clamping which comprises, a. a heavy, relatively rigid retaining beam extending over the tops of each of the mill stands and urging said stands downward against said foundation, b. said foundation forming a rigid support upon which said mill stands are seated, c. holding means on said retaining beam engaging said mill stands individually for independently forcibly urging said mill stands downward into seated positions on said foundation, and d. means for securing said retaining beam in working position over said mill stands.

8. The improvement of claim 7, further characterized by a. said holding means further including means engaging said mill stands individually for lifting with said beam.

9. The improvement of claim 7, further characterized by a. said means for securing said retaining beam comprising vertical guide means in said foundation, engageable with end areas of said beam, and clamp-like means for urging said beam downward in said guide means.

10. In a rolling mill of the type comprising a foundation, a plurality of individual mill stands adapted for removable reception in said foundation, mill drive means, means for clamping the mill stands in said foundation, and means for coupling the mill stands to said drive means, the improvement in said clamping which comprises, a. said foundation having upwardly extending end structures for confining a series of independent mill stands, b. fluid actuator means mounted on one of said end structures and operative, when energized to extend by fluid under pressure, to urge said mill stands toward the opposite end structure, and c. locking means operative when said actuator means is energized and extended for mechanically limiting retraction thereof.

11. The improvement of claim 10, further characterized by a. said actuator means comprising a plurality of hydraulic actuators having body portions and rod portions, b. the rod portions of said respective actuators having enlarged end portions for engagement with said mill stands, and c. said locking means comprising a platelike member mounted for vertical movement relative to said actuators and movable to a locking position between the body portions and the enlarged end portions of said actuators to limit retracting movement of said actuators.

12. The improvement of claim 11, further characterized by a. said plate having a plurality of keyhole-like openings therein, the narrow portions of said openings being adapted to receive said rods but too small to receive said enlarged ends, and the larger portions of said openings being adapted to receive said enlarged end portions.

13. In a rolling mill of the type comprising a foundation, a plurality of individual mill stands adapted for removable reception in said foundation, mill drive means, means for clamping the mill stands in said foundation, and means for coupling the mill stands to said drive means, the improvement in said coupling means which comprises, a. a clutch bar mounted on said foundation and extending longitudinally thereof, b. means on said clutch bar engageable with a plurality of mill drive couplings and operative upon transverse movement of said clutch bar to engage or disengage said couplings, c. a plurality of crank levers mounted on said foundation and having first arms engageable with said clutch bar, and d. an operating rod extending longitudinally of said foundation and engageable with second arms of each of said crank levers for effecting simultaneous pivoting thereof, e. the first arms of said crank levers extending in a generally longitudinal direction whereby pivoting movement thereof effects generally transverse movement of said clutch bar.

14. The improvement of claim 13, further characterized by a. the second arms of said crank levers extending generally transversely.

15. The improvement of claim 13, further characterized by a. said clutch bar comprising a plurality of segments arranged generally end to end and collectively extending for the full length of the mill, b. a pair of crank levers for each of said clutch bar segments, and c. a common, longitudinally extending operating rod for all of said crank levers.

* * * * *